US006209739B1

(12) United States Patent
Samsel

(10) Patent No.: US 6,209,739 B1
(45) Date of Patent: Apr. 3, 2001

(54) STORAGE CHEST WITH INTEGRAL HANDLE IN REINFORCED LID

(75) Inventor: Richard A. Samsel, Haines, FL (US)

(73) Assignee: Delta Consolidated Industries, Raleigh, NC (US)

( * ) Notice: Subject to any disclaimer, the term of this patent is extended or adjusted under 35 U.S.C. 154(b) by 0 days.

(21) Appl. No.: 09/241,685

(22) Filed: Feb. 1, 1999

(51) Int. Cl.[7] ..... B65D 25/28

(52) U.S. Cl. ..... 220/4.22; 16/412; 16/416; 206/278.1; 220/771

(58) Field of Search ..... 220/833–835, 220/810, 840, 770, 771, 755, 908, 212.5, 4.22; 224/404; 217/57, 58, 56; 206/278.1, 373; 312/902, 244, 100, 405; 16/443, 416, 412; 174/50

(56) References Cited

U.S. PATENT DOCUMENTS

| | | | | |
|---|---|---|---|---|
| D. 170,556 | * | 10/1953 | Sterling | D6/494 |
| 685,589 | * | 10/1901 | Everett | 220/810 |
| 1,178,773 | * | 4/1916 | Adams | 220/810 X |
| 1,643,905 | * | 9/1927 | Rossner | 220/810 X |
| 1,681,032 | * | 8/1928 | Fuller | 217/57 X |
| 1,756,746 | * | 4/1930 | Hogan | 206/278.1 X |
| 1,921,386 | * | 8/1933 | Edwards | 16/443 X |
| 2,409,926 | * | 10/1946 | Bloom | 217/57 X |
| 2,842,420 | * | 7/1958 | Hansen et al. | 312/348.6 |
| 2,939,604 | * | 6/1960 | Falk | 220/810 X |
| 3,255,607 | * | 6/1966 | Bair et al. | 206/545 X |
| 5,064,255 | * | 11/1991 | Inui et al. | 312/405 |
| 5,088,750 | * | 2/1992 | Beese et al. | 220/908 X |
| 5,407,218 | * | 4/1995 | Jackson | 280/30 |
| 5,573,319 | * | 11/1996 | Dirk | 312/100 |
| 5,613,451 | * | 3/1997 | Zook | 220/810 X |
| 5,671,991 | * | 9/1997 | Grant | 220/592.1 X |
| 5,782,352 | * | 7/1998 | Senda | 206/308.3 |
| 5,927,109 | * | 7/1999 | Sieck | 70/58 |

OTHER PUBLICATIONS

Eric Wilkison, Ace Truck Box Center, World WideWeb, pp. 1–5, Dec. 1998.*

Brochure for "KNAACK Jobsite Storage Equipment" Jun. 15, 1993.

* cited by examiner

*Primary Examiner*—Allan N. Shoap
*Assistant Examiner*—Joe Merek
(74) *Attorney, Agent, or Firm*—Myers Bigel Sibley & Sajovec

(57) ABSTRACT

The storage chest of the present invention comprises: a box portion having opposed front and rear walls, a pair of opposed side walls; and a floor attached to the front, rear and side walls to form a storage cavity; and a lid pivotally interconnected with the rear wall. The lid includes: a generally planar top panel; and a front panel merging with and extending generally perpendicularly to the top panel. The front panel includes a recess formed by a horizontally disposed face and a vertically disposed face positioned below and merging with the horizontally disposed face. The top panel and front panel are integrally formed from a unitary member of substantially constant thickness. The lid is moveable between a closed position, in which the top panel is generally horizontally disposed above the floor and the lid contacts at least one of the front, rear and side walls and prevents access to the storage cavity from above, and the front panel is positioned generally above the front wall, and an open position, in which the top panel takes a non-horizontal position, the front panel is positioned rearwardly of the front wall, and the lid allows access to the storage cavity from above. In this configuration, the recess in the front panel of the lid serves as a grasping handle for the lid, thereby eliminating the additional handle piece included in prior art lids.

21 Claims, 4 Drawing Sheets

STORAGE CHEST WITH INTEGRAL HANDLE IN REINFORCED LID

FIELD OF THE INVENTION

The present invention relates generally to storage chests, and more particularly to storage chests with hinged lids.

BACKGROUND OF THE INVENTION

Large storage chests often used in the construction industry are typically formed of steel sheet. The floor and walls of the chest can be formed either from a single sheet of steel that is bent at intersecting edges of the walls and floor to form a box or from multiple pieces of sheet steel that are welded together into a box. Tools can then be stored within the cavity of the box. Typical sizes for such a chest can range from 2 $ft^3$ to 8 $ft^3$ or even larger. Because it is often desirable for the chest to be at least somewhat portable, the walls may include pivoting carrying handles, which may be mounted to a straight wall or fold within a recess formed in the wall.

For protection of tools stored inside the chest cavity, the typical chest has a lid, also formed of sheet steel, that is hingedly attached to the rear wall of the box portion of the chest. Such a lid pivots between a closed position covering the cavity and an open position that allows access to the cavity. The lid should have sufficient strength and durability to withstand the abuse a chest typically endures, including the stacking of heavy objects on the lid.

In one popular lid model previously available from Delta Consolidated Industries under the tradename JOBOX®, the chest lid is formed of a single piece of sheet steel. The lid includes a horizontal panel that generally covers the chest cavity, vertical panels that extend downwardly from the edges of the horizontal panel, and flanges that extend inwardly (i.e., into the storage cavity) from the vertical panels. Together, the flanges form a rim within the vertical panels that rests upon the upper edges of the walls of the box portion of the chest when the lid is in its closed position. To add strength and rigidity to the lid, two bolster members are spot-welded to the underside of the horizontal panel; the bolster members extend from a rear to a front portion of the horizontal panel, stopping short of the front and rear vertical panels of the lid.

To assist in opening the lid, a handle is bolted to the center portion of the front vertical panel. Thus, by grasping and lifting the handle, a user can easily open the lid to access the storage cavity.

Unfortunately, this configuration has certain drawbacks. First, because the handle protrudes forwardly beyond the front wall of the box portion of the chest, it often gets crushed or bent during use. Also, by protruding, the handle provides an obstacle that a user can accidentally collide with or snag his clothing on. Moreover, in storing or shipping the chest, the protrusion of the handle requires additional space beyond the front wall of the chest. Further, the handle is an additional component that must be manufactured and assembled, thereby adding cost to the chest.

Second, the placement of the handle in the center of the lid requires that the user be positioned directly in front of the lid to open it; initiating lid opening by lifting another portion of the lid is difficult, because there is nothing else to grasp. Thus, the chest must be positioned where a user can reach the center portion of the lid to lift it.

SUMMARY OF THE INVENTION

In view of the foregoing, it is an object of the present invention to provide a storage chest lid without the inconvenience of prior handles.

It is another object of the present invention to provide a storage chest lid that lacks a protruding handle.

It is also an object of the present invention to provide a storage chest lid having a handle that enables the lid to be opened without the user being positioned directly in front of the center portion of the vertical panel of the lid. These and other objects are satisfied by the present invention, which provides a storage chest lid without a protruding handle. The storage chest of the present invention comprises: a box portion having opposed front and rear walls, a pair of opposed side walls; and a floor attached to the front, rear and side walls to form a storage cavity; and a lid pivotally interconnected with the rear wall. The lid includes: a generally planar top panel; and a front panel merging with and extending generally perpendicularly to the top panel. The front panel includes a recess formed by a horizontally disposed face and a vertically disposed face positioned below and merging with the horizontally disposed face. The top panel and front panel are integrally formed from a unitary member of substantially constant thickness. The lid is moveable between a closed position, in which the top panel is generally horizontally disposed above the floor and the lid contacts at least one of the front, rear and side walls and prevents access to the storage cavity from above, and the front panel is positioned generally above the front wall, and an open position, in which the top panel takes a non-horizontal position, the front panel is positioned rearwardly of the front wall, and the lid allows access to the storage cavity from above. In this configuration, the recess in the front panel of the lid serves as a grasping handle for the lid, thereby eliminating the additional handle piece included in prior art lids.

In a preferred embodiment, the lid includes a support member that extends between vertical side panels of the lid. This support member can stiffen the lid to a sufficient degree that any "racking" experienced by the lid when lifted from a non-centered grasping position is reduced significantly.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout, and some dimensions and thicknesses may be exaggerated for clarity.

Figure 1:
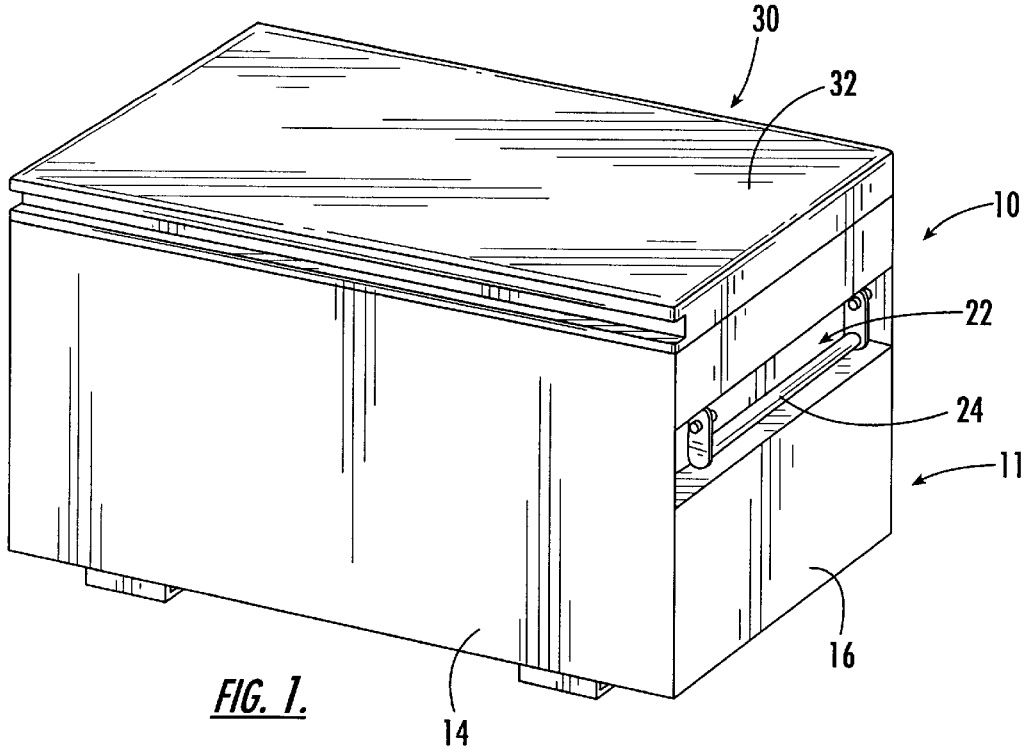
FIG. 1 is a perspective view of a storage box of the present invention with the lid in the closed position.
Figure 8:
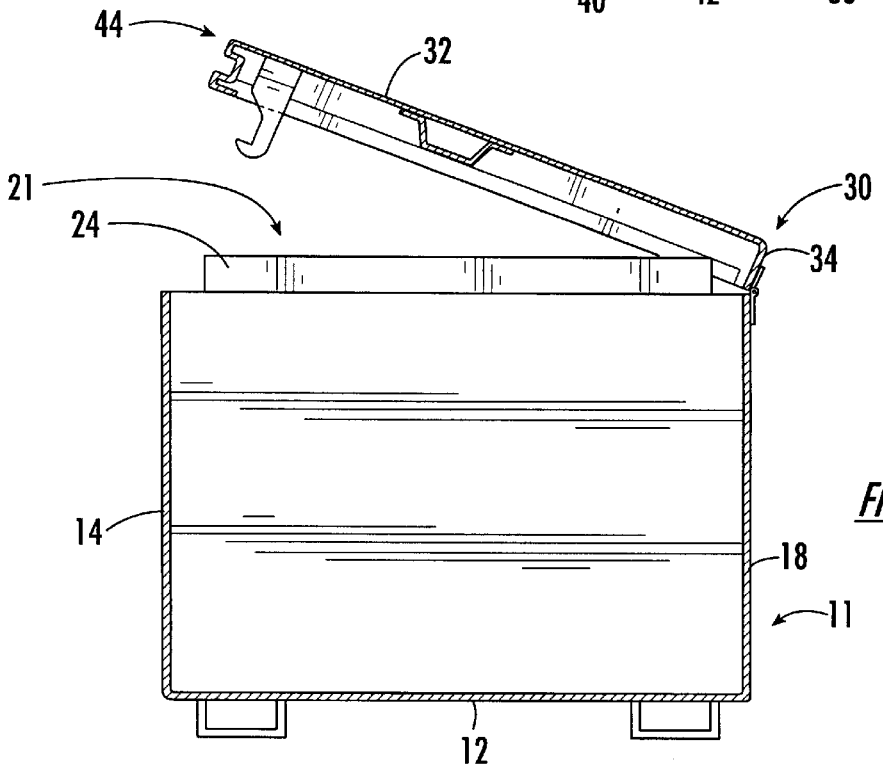
FIG. 8 is a side section view of the storage chest of FIG. 1 in the open position.

Referring now to the drawings, a storage chest designated broadly at 10 is illustrated in FIGS. 1 and 8. The chest 10 includes a box portion 11 and a lid 30 hingedly attached thereto. The lid 30 is movable between a closed position (FIG. 1) in which access to the interior cavity 21 of the box portion 11 is denied and an open position (FIG. 8) in which the interior cavity 21 of the box portion 11 can be accessed.

The box portion 11 includes a floor 12, a front wall 14, two opposed sidewalls 16, and a rear wall 18. The floor 12, front wall 14, sidewalls 16, and rear wall 18 define a cavity 21 within which tools or other items can be stored. Illustratively and preferably, the sidewalls 16 include recesses 22 in which carrying handles 24 are pivotally mounted. The front side and rear walls 14, 16 and 18 include a lip 25 on their upper edges. The floor 12 and walls 14, 16 and 18 of the box portion 11 are preferably formed of sheet steel or sheet aluminum having a thickness of between about 0.0299 and 0.1875 inches.

Those skilled in this art will recognize that, although the rectangular shape of the box portion 11 illustrated herein is preferred, other configurations, such as one in which the box portion 11 has a square footprint or a rectangular footprint of different dimensions, can also be used with the present invention. An exemplary alternative configuration is a chest (often referred to as a "slope lid" chest) that has a lid that is hinged at its rear edge and slopes downwardly and forwardly toward the front wall of the chest. An exemplary slope lid chest is also available from Delta Consolidated Industries, Raleigh, N.C., under the name JOBOX®.

Figure 3:
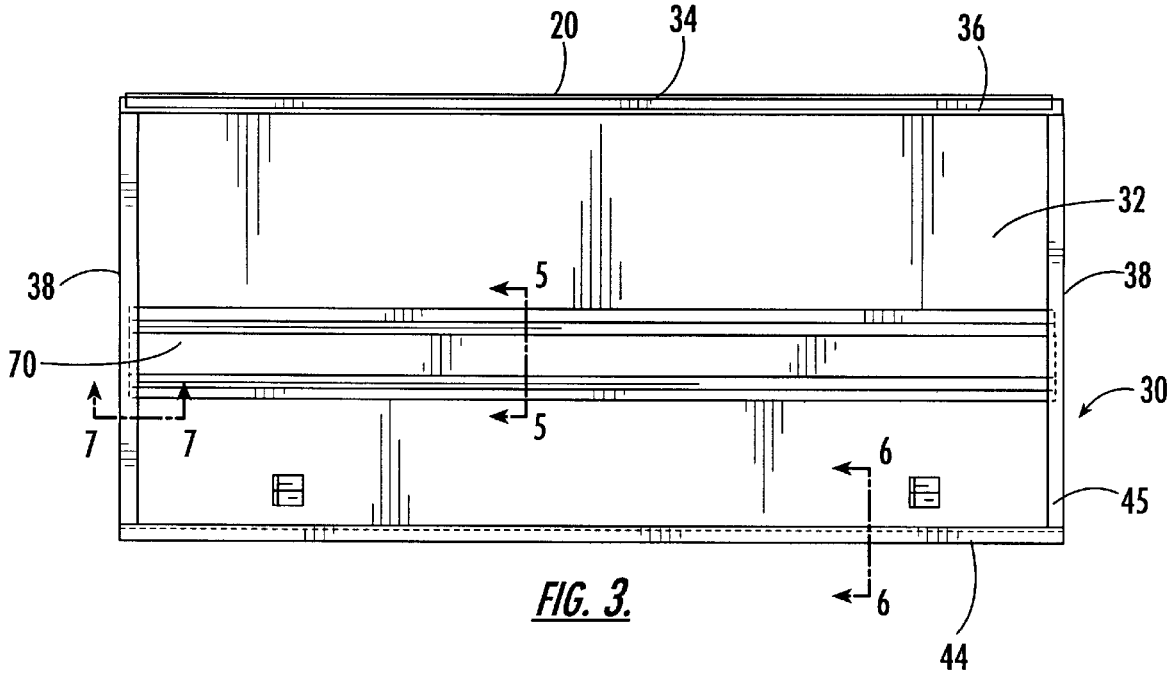
FIG. 3 is a bottom view of the lid of FIG. 1.
Figure 4:
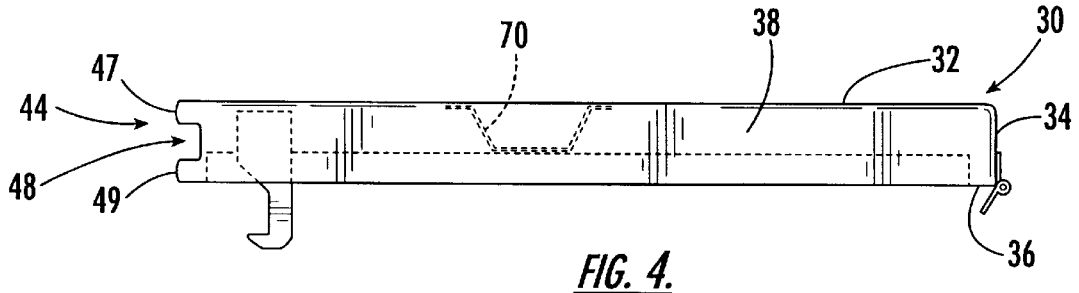
FIG. 4 is a side view of the lid of FIG. 1.
Figure 7:
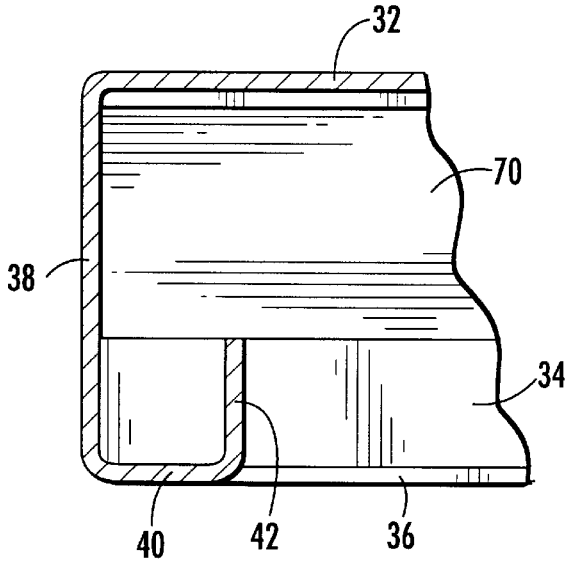
FIG. 7 is a greatly enlarged front section view of a side panel of the lid of FIG. 1.

The lid 30 is pivotally attached to the upper edge 19 of the rear wall 18 via a hinge 20 (see FIGS. 1 and 8). Referring now to FIGS. 3 and 4, the lid 30 includes a generally horizontally disposed top panel 32, a rear vertical panel 34, a pair of opposed vertical side panels 38, and a front vertical panel 44. Each of the vertically disposed panels 34, 38, and 44 merges with and extends downwardly from a respective edge of the top panel 32. Typically, the panels 34, 38, and 44 extend downwardly from the top panel 32 between about 1.5 and 3.5 inches. Each of the side panels 38, rear panel 34 and front panel 44 includes an inwardly-extending lip (designated at 40, 36 and 46, respectively) that merges with the lower edge of the respective panel (see FIGS. 3 and 7). As used herein "inwardly-extending" means that the component extends toward or into the interior portion of the lid 30. Together, the lips 36, 40, 46, which extend inwardly between about 0.5 and 1.25 inches, form a rim 45 that is positioned just inwardly from the panels 34, 38, 44. Also, a flange 42 merges with and extends upwardly between about 0.5 and 1.25 inches from the inner edge of each lip 40 (FIG. 7).

Figure 6:
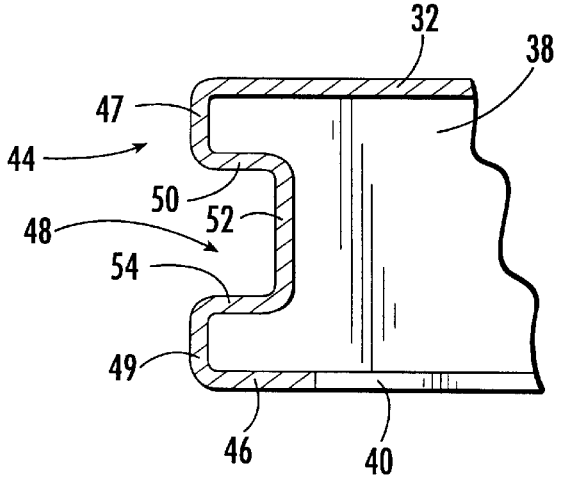
FIG. 6 is a greatly enlarged side section view of the front panel of the lid of FIG. 1.

The front vertical panel 44 (FIGS. 4 and 6) includes an upper face 47 and a lower face 49, which are illustratively and preferably substantially coplanar with one another. The upper face 47 is separated from the lower face 49 by an inwardly extending recess 48. The recess 48 includes horizontal top and bottom faces 50, 54 that extend inwardly from respective edges of the upper and lower faces 47, 49 and a vertically disposed vertical face 52 that extends between the top and bottom faces 50 and 54. Preferably, the recess 40 extends horizontally the entire expanse of the front vertical panel 44; that is, it extends continuously between the side vertical panels 38. Also, it is preferred that the recess 48 extend inwardly between about 0.25 and 1.0 inches, and that the upper and lower faces 47, 49 be separated from one another by between about 0.5 and 1.5 inches.

Figure 5:
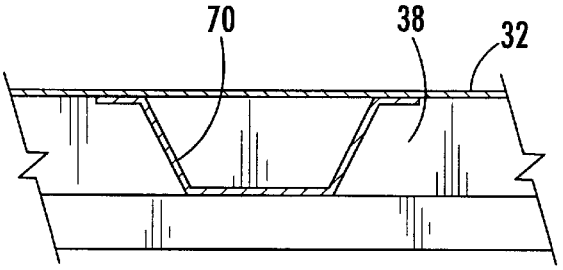
FIG. 5 is an enlarged side section view of the support member attached to the lid of FIG. 1.

A support member 70 (FIGS. 4 and 5) is fixed to the underside of the top panel 32 and extends between the side vertical panels 38 to rigidify the lid 30. Illustratively and preferably, the support member 60 has a "trough" shape and is fixed to the upper edges of the flanges 42 on either end.

Figure 2:
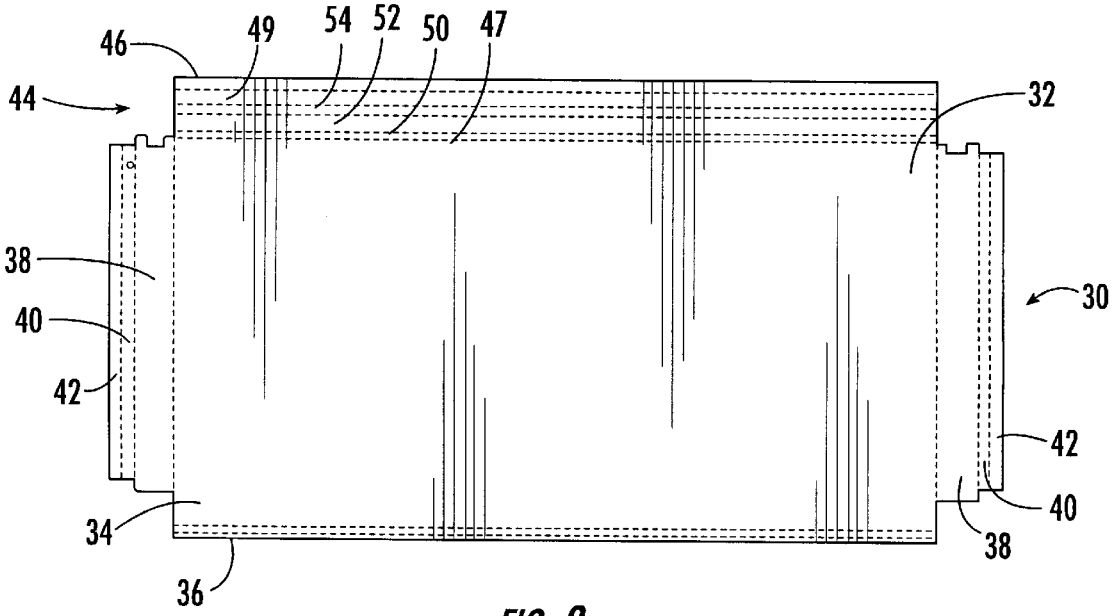
FIG. 2 is a plan view of a blank used to form the lid illustrated in FIG. 1.

The lid 30 can be formed from a unitary sheet (typically a metal sheet, such as steel or aluminum), such as the flat blank 70 illustrated in FIG. 2. As can be seen in FIG. 2, the blank 70 includes the top panel 32, which shares edges with the rear panel 34, the side panels 38, and the front panel 44. The corresponding lips 36, 40, 46 and flanges 42 can also be seen in FIG. 7 to share edges with their respective panels.

Referring back to FIGS. 1, 4 and 6, it can be seen that the recess 48 provides a grasping location on the lid 30. Thus, the lid 30 can be moved between the closed position of FIG. 1, in which the top panel 32 is disposed above the floor 12 and covers the box portion 11, with the rim 45 resting on the upper edges of the box portion 11, and the open position, in which the top panel 32 is pivoted about the hinge 20 to a non-horizontal position and the front panel 44 is positioned rearwardly on the front wall 14. Of course, when the lid 30 is in the closed position, access to the cavity 21 is denied, and when the lid 30 is in the open position, the cavity 21 is accessible.

As stated above, the presence of the recess 48 in the front panel 44 of the lid 30 provides a grasping location for moving the lid 30 between its open and closed positions. The recessed configuration addresses the shortcomings in the prior art mentioned above. First, the recess 48 does not protrude outwardly from the front panel 44, and thus does not present the storage and nuisance concerns of a protruding handle. Second, because the recess 48 is integrally formed within the front panel 44, there is no need for an additional handle component that adds expense to the unit. Third, because the recess 48 extends the length of the lid 30, it provides a grasping location at all points on the lid 30 rather than simply in the lid's center portion. Fourth, the recess 48 can be formed in a simple and straightforward bending operation that should be quite inexpensive.

The inclusion of the recess 48 in the lid 30 also provides an additional performance advantage to the lid 30; namely, the strength and rigidity of the lid 30 are increased significantly, particularly in the front portion of the lid. The profile defined by the front panel 44 (seen best in FIG. 6) resembles a corrugation that markedly increases the strength and stiffness of the front panel 44 (and, in turn, the remainder of the lid 30).

Although the lid 30 can be grasped and lifted at points other than the central portion of its front panel 44, it can have a tendency to "rack"(i.e., twist about an axis extending diagonally across the lid between opposite corners) when grasped and lifted near one of the ends of the lid 30 rather than the center. This tendency can be addressed by the inclusion of the support member 70, and in particular the attachment of the support member 70 to both the underside of the top panel 32 and the flanges 42. By affixing the support member to the flanges 42, an integrated stiffening assembly comprising the support member 70, the side panels 38, the lips 40 and the flanges 42 is formed that is highly resistant to racking.

Figure 9:
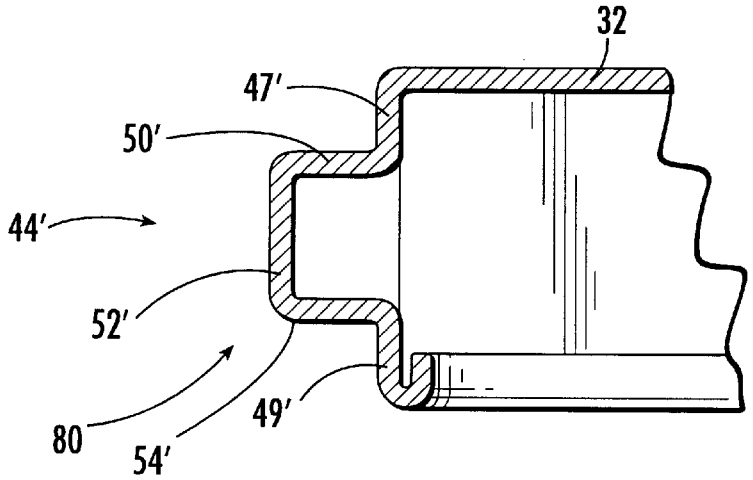
FIG. 9 is a section view of a front panel of the lid of another embodiment of the storage chest of the present invention.
Figure 10:
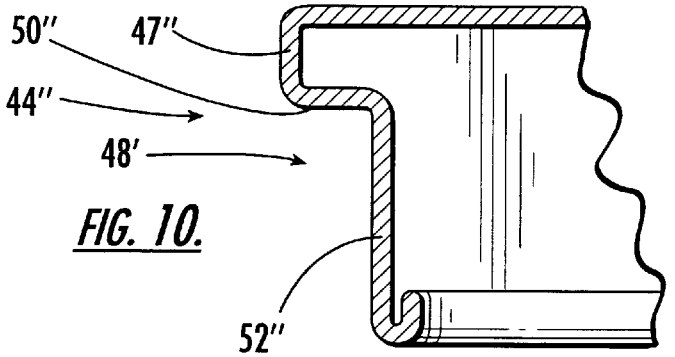
FIG. 10 is a section view of a front panel of the lid of another embodiment of the storage chest of the present invention.

Those skilled in this art will appreciate that these advantages can also be provided by alternative embodiments of the present invention, two of which are illustrated in FIGS. 9 and 10. In FIG. 9, a front panel 44' includes upper and lower faces 47', 49' that are recessed from a protruding rib 80 formed by top and bottom faces 50', 54' and a vertically-disposed face 52'. In FIG. 10, a front panel 44" includes an upper face 47" and a recess 48' defined by a horizontally-disposed top face 50" and a vertical face 52". In each instance, the front panels 44', 44" of these embodiments include a horizontally-disposed face that merges with a vertical face positioned below that horizontal face such that a grasping location for lifting is formed; thus, the performance advantages of front panel 44 of the lid 30 are also achieved by these embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A storage chest comprising:

a box portion having:

opposed front and rear walls; and a floor attached to said front and rear walls to form a storage cavity; and a lid pivotally interconnected with said rear wall, said lid including:

a generally planar top panel;

a front panel merging with and extending generally perpendicularly to said top panel, said front panel including a recess formed by two opposed horizontally disposed faces spaced apart from and positioned beneath said top panel and a vertically disposed face positioned between and merging with a rearward edge of each said horizontally disposed face;

said front panel having generally vertical faces above and below said recess;

wherein said top panel and front panel are integrally formed from a unitary member of substantially constant thickness;

wherein said lid is moveable between a closed position, in which said top panel is generally horizontally disposed over said floor, such that said lid prevents access to said storage cavity from above, and said front panel is positioned generally above said front wall, and an open position, in which said top panel takes a nonhorizontal position, said front panel is positioned rearwardly of said front wall, and said lid allows access to said storage cavity from above;

wherein said top panel, said front panel, and said recess are formed by folding said unitary member.

2. The storage chest defined in claim 1, wherein said lid further comprises side panels that merge with and extend perpendicularly from said top panel, said top, front and side panels being integrally formed from a unitary member of substantially constant thickness.

3. The storage chest defined in claim 2, wherein said lid further comprises a rear panel that merges with and extends perpendicularly to said top panel, said top, front, side and rear panels being integrally formed from a unitary member of substantially constant thickness.

4. The storage chest defined in claim 3, further comprising a respective inwardly-extending lip merging with each of said front, side and rear panels.

5. The storage chest defined in claim 4, further comprising a respective upwardly-extending flange merging with each of the inwardly-extending lips attached to said side panels.

6. The storage chest defined in claim 5, wherein said lid further comprises a support member extending between said side panels and attached to said top panel and said upwardly-extending flanges of said side panels.

7. The storage chest defined in claim 1, wherein said lid is formed of sheet metal having a thickness of between about 0.0299 and 0.1875 inches.

8. The storage chest defined in claim 2, wherein said recess extends the horizontal length of said front panel and terminates at each end at said side panels.

9. The storage chest defined in claim 2, wherein, in the closed position, said side panels are positioned generally over side walls of said box portion, and said rear panel is positioned generally over said rear wall.

10. A storage chest comprising:

a box portion having:

opposed front and rear walls;

a pair of opposed side walls; and a floor attached to said front, rear and side walls to form a storage cavity; and a lid pivotally interconnected with said rear wall, said lid including:

a generally planar top panel;

a front panel merging with and extending generally perpendicularly to said top panel, said front panel including upper and lower faces, a rearwardly-extending handle recess positioned between said upper and lower faces;

a rearwardly-extending first lip merging with and extending generally perpendicularly away from said lower face;

a rear panel that merges with and extends perpendicularly to said top panel;

a forwardly-extending second lip merging with and extending generally perpendicularly away from said rear panel;

opposed side panels that merge with and extend generally perpendicularly away from said top panel;

inwardly-extending third and fourth lips that merge with and extend generally perpendicularly away from said respective side panels; and upwardly-extending flanges that merge with and extend generally perpendicularly away from, respectively, said third and fourth lips;

wherein said top panel, front panel, rear panel, side panels, first, second, third and fourth lips, and said flanges are integrally formed from a unitary member of substantially constant thickness;

wherein said lid is moveable between a closed position, in which said top panel is generally horizontally disposed over said floor such that said lid prevents access to said storage cavity from above, and said front panel is positioned generally above said front wall, and an open position, in which said top panel takes a nonhorizontal position, said front panel is positioned rearwardly of said front wall, and said lid allows access to said storage cavity from above; and wherein said lid further comprises a support member extending between said side panels and attached to said top panel and said upwardly-extending flanges of said side panels.

11. The storage chest defined in claim 10, wherein said lid is formed of sheet metal having a thickness of between about 0.0299 and 0.1875 inches.

12. The storage chest defined in claim 10, wherein said recess extends the horizontal length of said front panel and terminates at each end at said side panels.

13. The storage chest defined in claim 10, wherein, in the closed position, said side panels are positioned generally over said side walls, and said rear panel is positioned generally over said rear wall.

14. A lid for use with a storage chest, said lid including:

a generally planar top panel;

a front panel merging with and extending generally perpendicularly to said top panel, said front panel including generally vertical upper and lower faces and a rearwardly-extending handle recess positioned between said upper and lower faces and spaced apart from and beneath said top panel; said recess formed by two horizontally disposed faces extending rearwardly from said upper and lower faces, a vertically disposed face positioned between and merging with a rearward edge of each horizontally disposed face, wherein said top panel and front panel are integrally formed from a unitary member of sheet metal of substantially constant thickness, said top panel, said front panel, and said recess, being formed by folding said unitary member.

15. The lid defined in claim 14, wherein said lid further comprises side panels that merge with and extend perpendicularly from said top panel, said top, front and side panels being integrally formed from a unitary member of substantially constant thickness.

16. The lid defined in claim 14, wherein said lid further comprises a rear panel that merges with and extends perpendicularly to said top panel, said top, front, side and rear panels being integrally formed from a unitary member of substantially constant thickness.

17. The lid defined in claim 16, further comprising a respective inwardly-extending lip merging with each of said front, side and rear panels.

18. The lid defined in claim 17, further comprising a respective upwardly-extending flange merging with each of the inwardly-extending lips attached to said side panels.

19. The lid defined in claim 18, wherein said lid further comprises a support member extending between said side panels and attached to said top panel and said upwardly-extending flanges of said side panels.

20. The lid defined in claim 14, wherein said lid is formed of sheet metal having a thickness of between about 0.0299 and 0.1875 inches.

21. The lid defined in claim 14, wherein said recess extends the horizontal length of said front panel and terminates at each end at said side panels.

* * * * *